United States Patent [19]

Olsen et al.

[11] 4,356,914

[45] Nov. 2, 1982

[54] ASYMMETRIC CONTAINER CARRIER STOCK

[75] Inventors: Robert C. Olsen, Streamwood; William N. Weaver, Northbrook, both of Ill.

[73] Assignee: Illinois Tool Works Inc., Chicago, Ill.

[21] Appl. No.: 100,681

[22] Filed: Dec. 5, 1979

[51] Int. Cl.[3] ..... B65D 75/00

[52] U.S. Cl. ..... 206/150; 206/158

[58] Field of Search ..... 206/150, 158, 145, 151, 206/161

[56] References Cited

U.S. PATENT DOCUMENTS

| | | | |
|---|---|---|---|
| 2,874,835 | 2/1959 | Poupitch . | |
| 2,989,177 | 6/1961 | Swick . | |
| 2,997,169 | 8/1961 | Poupitch | 206/150 |
| 2,997,169 | 8/1961 | Poupitch . | |
| 3,269,530 | 8/1966 | Wanderer . | |
| 3,325,004 | 6/1967 | Wanderer | 206/150 |
| 3,608,949 | 9/1971 | Owen | 206/150 |
| 3,874,502 | 4/1975 | Weaver | 206/150 |
| 4,149,631 | 4/1979 | Cunningham | 206/150 |

*Primary Examiner*—Joseph Man-Fu Moy

*Attorney, Agent, or Firm*—Thomas W. Buckman

[57] ABSTRACT

A strip of container carrier stock formed from a thin resilient plastic sheet material which is designed to be applied to containers by machines and which may particularly accommodate stretching forces applied nonsymmetrically relative to either the longitudinal axis of the stock or to the lateral axis extending across each laterally aligned series of bands. The stock of this invention is thus configured to be nonsymmetrical about the longitudinal axis of the stock or about a lateral axis extending through the midpoints of each row of container receiving aperture creating bands.

6 Claims, 6 Drawing Figures

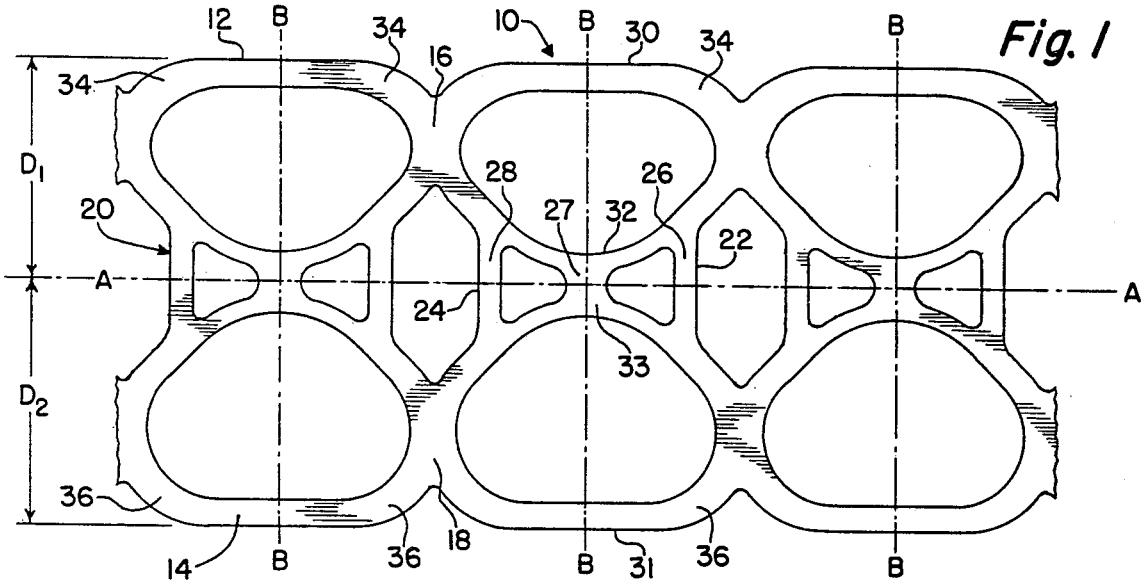
Fig. 1
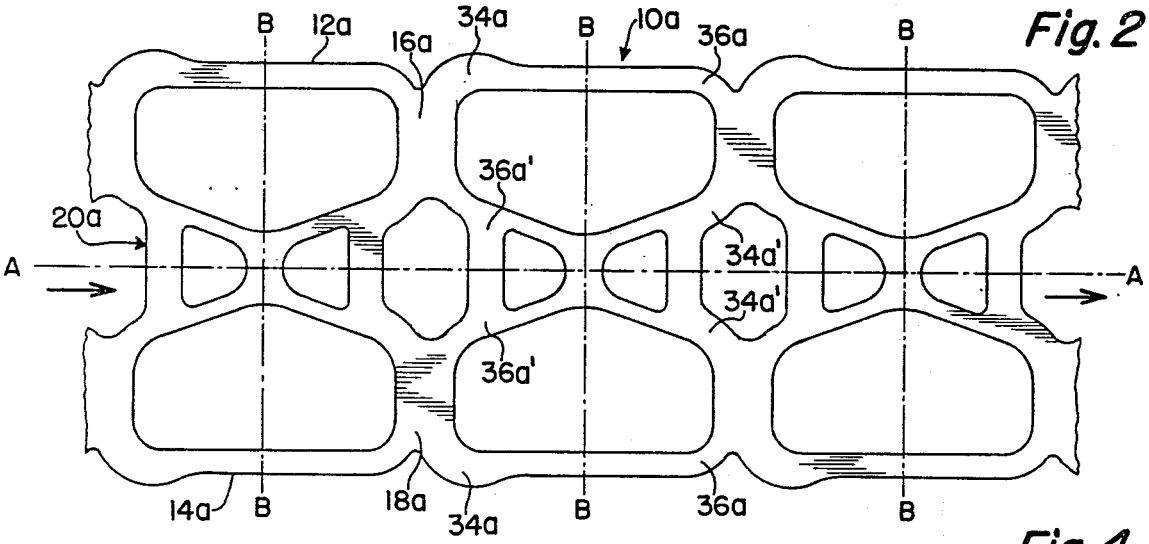
Fig. 2
Fig. 3
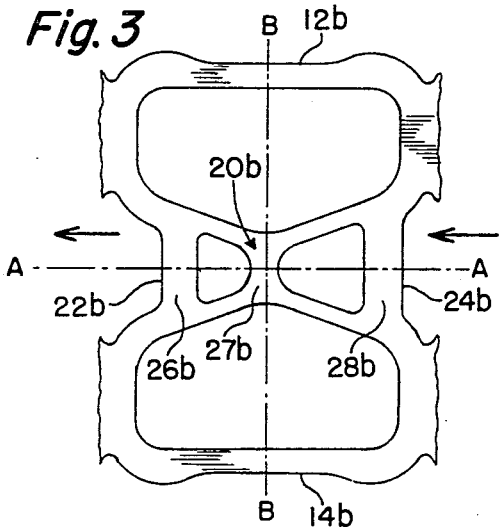
Fig. 4
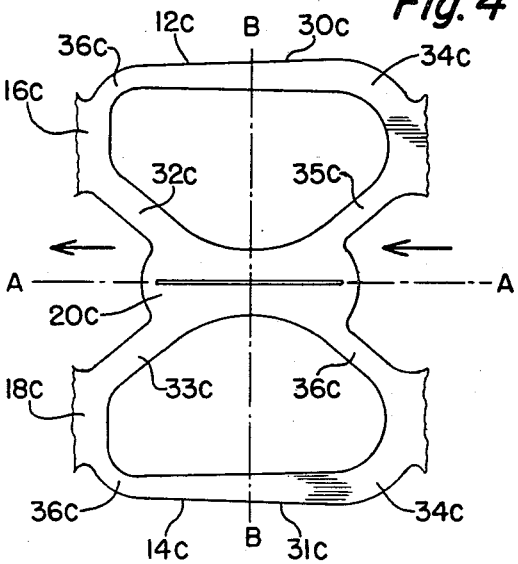

ASYMMETRIC CONTAINER CARRIER STOCK

BACKGROUND OF THE INVENTION

This invention relates generally to a strip of thin resilient plastic material including a plurality of longitudinal rows of bands for receiving a plurality of rows of containers.

The invention more specifically relates to a carrier stock for machine application where stretching forces for applying the strip to the rows of containers is nonuniform relative to either the longitudinal axis of the strip stock or to the lateral axis of each rank of container receiving bands.

Heretofore, container stock of the type generally described has been symmetrical about the axis of the stock and the axis of each laterally aligned rank of bands. Typical symmetrical carriers are shown in U.S. Pat. Nos. 2,874,835; 3,711,145; 3,874,502 and 4,018,331.

Furthermore, the carriers typified by the above patents have been utilized with machines, such as shown in U.S. Pat. No. 3,383,828, or which use a pin for gradually and continuously snapping the carrier strip bands beneath the chimes of cans without substantial stretching or with machines, such as shown in U.S. Pat. Nos. 3,221,470; 3,775,935; 3,816,968 and 3,959,949 which use jaw-like stretching members arranged about a rotating drum designed to gradually stretch each aperture a desired amount so that the bands may be snapped beneath the chimes of the associated container. In these rotating jaw-type machines, the stretching forces to be absorbed by the carrier strip are generally uniform in that a pair of opposing jaws that are either applied to the strip or to each individual aperture are both moving relative to one another as the drum rotates. Thus, a high differential stress situation on the carriers is not encountered with these machines.

However, with the advent of different machine applicating techniques incorporating different stretching forces to be absorbed by the carrier strip coupled with the desire to use a thinner gauge material and less material in the carrier, the problems of concentration of stress forces or differential loading during carrier application become important. For example, new machine concepts, such as those typified in U.S. Pat. No. 4,111,135 and U.S. Ser. No. 59,019 may create a localization of stress in certain regions of a thin carrier strip and which may be detrimental to both the application and to the resulting package. Both of these two machine concepts apply relatively uneven stretching force to the carrier strip when compared with the above-noted prior art techniques. In the first mentioned new machine concept, each rank of container encircling bands is stretched through the use of solely the containers themselves in a manner which creates more stress in certain regions of the rear area of bands than in the corresponding front areas of the same bands. Likewise, the second mentioned new machine concept utilizes a rotating drum in which a plurality of pairs of jaws include only a single moving jaw member and single stationary jaw to stretch an entire rank of container encircling bands. Thus, the band which is associated with the moving jaw tends to move more and is subject to a higher stress than the band which is associated with the stationary jaw.

SUMMARY OF THE INVENTION

When viewed relative to the foregoing background, the subject invention represents a unique advance in the art. The subject invention is unique because it involves a carrier strip stock which can be engineered to utilize a minimum amount of material and still be capable of being applied using high localized, stretching forces which may be nonuniform on the bands relative to either the longitudinal axis of the stock or to each lateral axis of each rank of laterally aligned container receiving bands.

The container carrier stock of this invention includes a plurality of rows of container encircling bands which are interconnected by lateral web means. Each longitudinally adjacent band in each row is also connected by a longitudinal web. Each successive rank of laterally aligned container-receiving bands are identical and each successive band in a given longitudinal row of bands are also identical. The objects of the inventions may be achieved by a variety of carrier stock configurations contemplated herein, but briefly may be summarized as either widening the bands in certain areas of the bands which are to receive a localized high stretching force or by designing the bands so that the dimension from a reference axis to a side which receives the most stress is less than a similar dimension to the other side. Furthermore, various alternate locations of connections of webs to adjacent bands can be utilized to reduce the deleterious effect of nonuniform stretching forces applied to carrier stock. Other objects and features of the invention will be apparent upon perusal of the following specification and accompanying drawings.

BRIEF DESCRIPTION OF THE DRAWINGS

FIG. 1 is a plan view of a carrier in carrier stock constructed according to the invention.

FIG. 2 is a plan view of a carrier in another embodiment of the invention.

FIG. 3 is a plan view of a carrier in yet another embodiment of the invention.

FIG. 4 is a plan view of a portion of a carrier of still another embodiment of the invention.

DETAILED DESCRIPTION OF THE PREFERRED EMBODIMENTS

Figure 5:
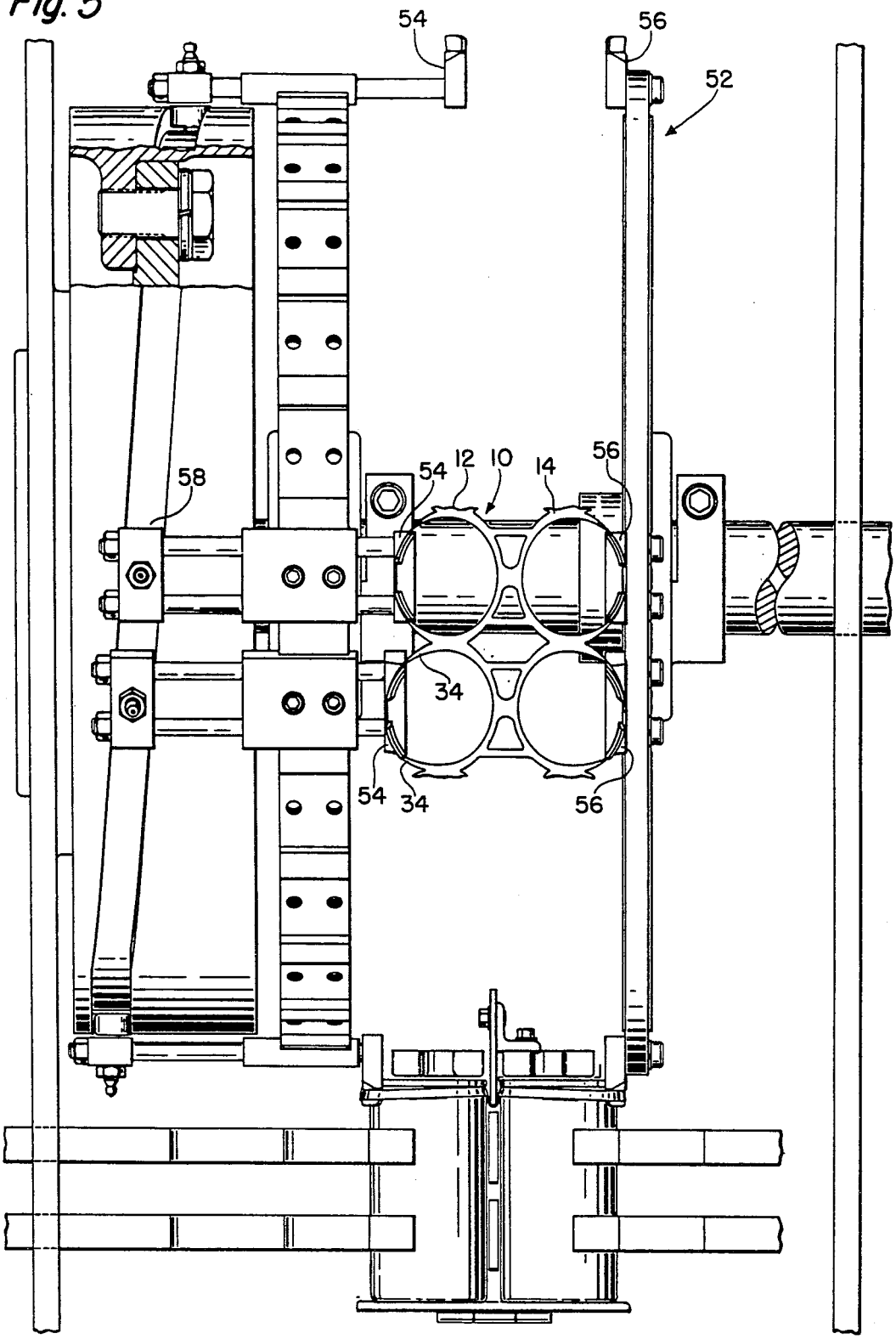
FIG. 5 is a partial elevational view of a machine which may be utilized to apply one form of the invention.

Turning first to FIG. 1 and with brief reference to FIG. 5, a preferred embodiment of the invention will be described. Carrier stock 10 basically includes a pair of longitudinally extending rows of container encircling bands 12 and 14. Laterally aligned sets of bands 12 and 14 form a plurality of identical ranks while each band in row of bands 14 are identical as are each band in row of bands 12 identical.

The row of bands 12 are interconnected by longitudinal webs 16 while the row of bands 14 are similarly connected by longitudinal webs 18. Each plurality of laterally aligned bands 12 and 14 comprising a rank are interconnected by a lateral web means 20. In the embodiment shown, web means 20 consists of discrete longitudinally spaced bands 26, 27 and 28 interconnecting inner band regions 32 and 33 of bands 12 and 14 respectively with the longitudinal extremities of 20 defined by edges 24 and 22.

The strip 10 may be defined as including two different reference axis about which symmetry is to be compared. Reference axis "A" extends lengthwise of the strip and is located intermediate the outer margins of the stock and preferably midway between innermost band regions of the laterally adjacent bands 12 and 14. Likewise, a separate lateral reference axis "B" is associated with each rank of bands 12 and 14. Rank axis, or lateral axis, "B" extends perpendicular to longitudinal axis "A" and is positioned midway between the longitudinal extremities of the apertures created by the bands 12 and 14.

A brief reference to FIG. 5 will describe the importance of the embodiment shown in FIG. 1. The machine typified in FIG. 5 will be shown to include a drum-type device 52 having a plurality of opposed jaw members 54 and 56 rotating about a fixed axis. This machine is more clearly described in the above noted Ser. No. 59,019. Each jaw member is associated with the outermost band of a carrier stock 10. However, it should be noted that jaw member 56 does not move laterally and the entire stretching action is performed by the moving jaw 54. The moving jaw 54, in a manner typical of prior art drum-type machines, is actuated by a cam arrangement 58. With the cooperation of the stationary jaw 56, the bands 12, in the row associated with the moving jaw 54, tend to be stretched more and receive more stretching forces than the bands 14. Accordingly, it has been found that high unit stresses appear in regions 34 of the row of bands 12.

Now with further reference to FIG. 1, it will be shown that these regions 34 in the row of bands 12 are slightly wider than the associated regions 36 in the row of bands 14. This increase of material thus accepts and accommodates nonuniform stretching forces occurring in the lateral direction and further permits the carrier to be made with less material and still apply effectively to cans.

A slight modification of the invention of FIG. 1 is also shown wherein the lateral dimension $D_1$ taken from longitudinal axis "A" to the outermost margin of the outer band region 30 of bands 12 is slightly less than the lateral dimension $D_2$ taken again from the longitudinal axis "A" to the outermost margin of the outer band 31 to bands 14. This will accomplish much the same purpose as the widening of the bands described above, in that the greater stretching movement and force on row of bands 12 is absorbed by a smaller aperture. FIG. 1 shows both of the abovementioned techniques in a single carrier, resulting in asymmetry about longitudinal axis "A", but it should be understood either or both could be properly utilized and come within the scope of this invention.

Figure 6:
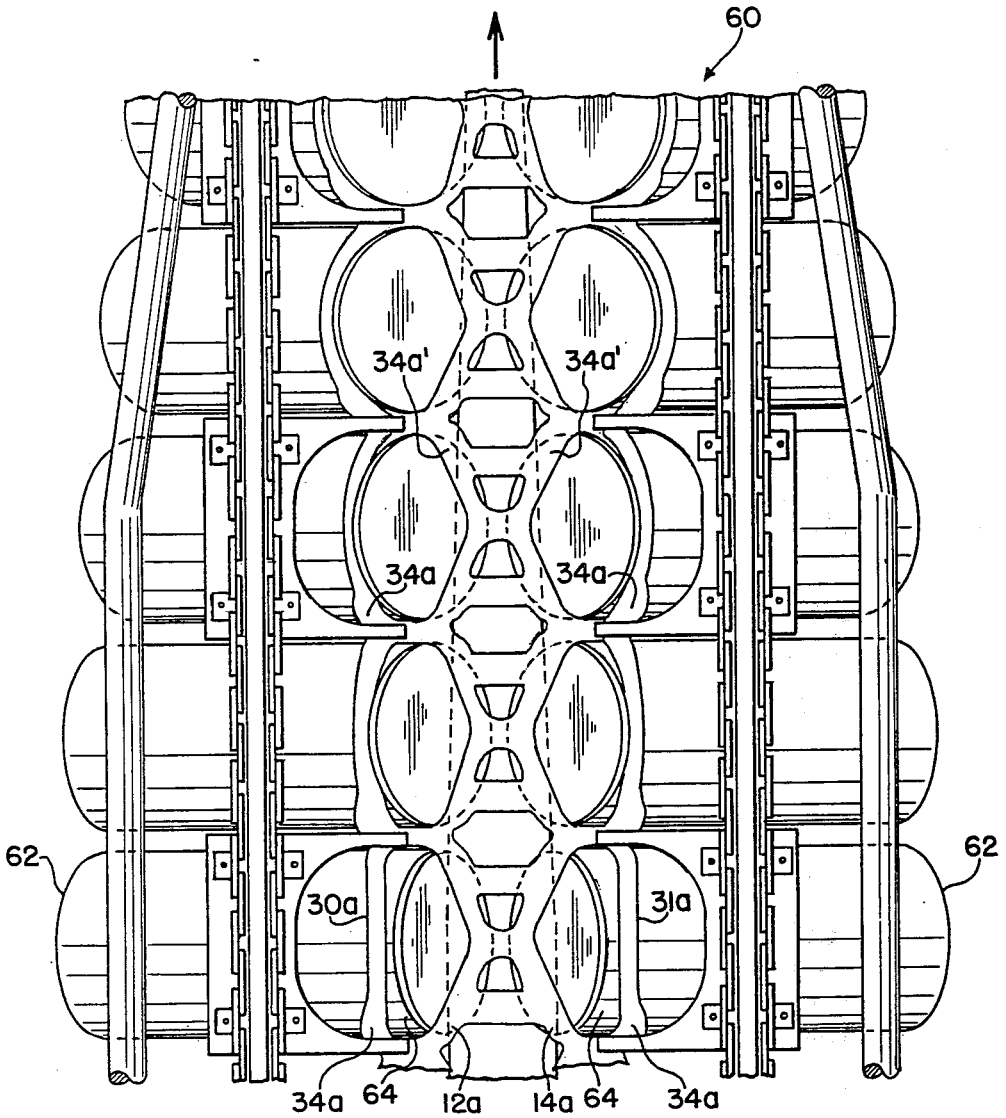
FIG. 6 is a partial plan view of another machine which may be utilized to apply another form of the invention.

With reference now to FIGS. 2–4, further embodiments of the invention will be described, and their adaptability to function efficiently with a carrier applying technique which is typified by a machine such as shown in FIG. 6. Throughout the discussion of these various embodiments, like reference numerals are intended to designate similar elements or components to the carrier stock of FIG. 1 by the addition of suffixes a, b, c to the appropriate elements in embodiments shown in FIGS. 2, 3 and 4 respectively.

Carrier strip 10*a* shown in FIG. 2 includes pairs of laterally aligned bands 12*a* and 14*a* with the longitudinal row of bands 12*a* connected by longitudinal web 16*a* and the longitudinal row of bands 14*a* connected by longitudinal web 18*a*. The laterally adjacent bands 12*a* and 14*a* defining a rank are connected by a lateral web means 20*a*. Reference to FIG. 6 will describe the importance of the asymmetry about the rank axis "B" in this embodiment. In the machine 60, the cans 62 themselves are used as the stretching members so that the outer periphery 64 of each can is associated with the outer band region 30*a* and 31*a* in rows of bands 12*a* and 14*a* respectively. The machine is described in greater detail in the above noted U.S. Pat. No. 4,111,135. The cans are fed on a conveyor moving in the direction of the arrow in a tilted condition so that they may readily be associated with the outer band regions. The cans are then gradually tipped up to become in parallel alignment. Due to the motion of moving the cans in the longitudinal direction of the machine while the stretching force is applied, a stress concentration has been found to occur at the lower regions of the bands 12*a* and 14*a* as at 34*a* and a similar related stress concentration in the same bands in a diagonally opposing upper region area 34*a*'.

Turning back to FIG. 2, it will be shown that band areas 34*a* and 34*a*' in each band 12*a* and 14*a* are slightly wider as by a localized bulging relative to their associated areas 36*a* and 36*a*' to accept and accommodate to nonuniform stretching forces occurring in the longitudinal direction. This asymmetry about the lateral or rank axis "B" also permits the carrier strip 10*a* to be reduced in weight and still produce efficient application.

In FIG. 3, an alternate manner of accommodating the nonuniform application of stretching forces about a rank axis "B" is utilized in a carrier stock 10*b*. A portion of carrier stock 10*b* showing only one pair of laterally aligned bands 12*b* and 14*b* illustrates the principles of this invention. In this embodiment, the longitudinal extremities of the lateral web 20*b* connecting laterally aligned bands 12*b* and 14*b* are shown as 22*b* and 24*b* with extremity 22*b* being forward relative to the machine direction of the stock, as shown by the arrow. In this embodiment, the rear extremity 24*b* is positioned to be further from the rank axis "B" then the front extremity 22*b*. This additional support in the rear area of each aperture will also accommodate the unsymmetrical stretching forces placed upon a strip by a machine or technique typified in FIG. 6.

A still further embodiment of the invention designed to be utilized in a machine or technique which applies unsymmetrical, longitudinal stretching forces is shown in FIG. 4. A portion of a carrier strip showing only one pair of laterally aligned bands 12*c* and 14*c* incorporates features which will accommodate such nonuniform forces. A solid lateral web 20*c* interconnects bands 12*c* and 14*c* and lateral webs 16*c* and 18*c* connect longitudinally adjacent bands 12*c* and 14*c* respectively. However, it should be noted the outer bands 30*c* and 31*c* are gradually widened from the front of the apertures to a maximum width at junction regions 34*c* adjacent the longitudinal webs 18*c* and 16*c*. Thus regions 34*c* are greater in width than the associated upper regions 36*c* of the same. The upper inner bands regions 32*c* and 33*c* may be of greater width than associated lower inner band regions 35*c* and 37*c*, in a manner similar to the diagonal relationship discussed relative to FIG. 2. Again, such an embodiment will sufficiently accept the unequal stretching forces to the rank of bands.

While the invention has been described as useful in embodiments with only two rows of bands, it should be apparent that the same features of the invention can be utilized with strip stocks which have more than two rows of bands where nonuniform stretching forces are present.

While the invention has thus been described in conjunction with specific embodiments thereof, it is therefore evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. Asymmetric carrier stock for machine application to a plurality of rows of substantially identical containers, said stock formed from a resilient, deformable plastic sheet material of uniform thickness, comprising a plurality of longitudinally and laterally directed and aligned, rows and ranks respectively, integrally joined, container encircling bands, each of said bands defining an aperture of predetermined shape and circumferential dimension, the predetermined circumferential dimensions of each of the bands being generally equal and less than a predetermined outer circumferential dimension of containers intended to be associated therewith, each longitudinally adjacent pair of bands being joined by longitudinal web means, the longitudinally adjacent pair of bands being uniformly spaced by the longitudinal web means for selective severance transverse the stock through any selected pair of longitudinal web means, each laterally adjacent pair of bands being joined by lateral web means, two different, intersecting reference axes created in the stock, a first reference axis being a longitudinal axis defined as extending along the stock, parallel to the longitudinal rows, intersecting the lateral web means and equidistant between the innermost band segment of each rank of laterally aligned bands which are joined by said lateral web means, a second reference axis being a rank axis perpendicularly intersecting the stock longitudinal axis, a plurality of such rank axes included in said stock with each rank being intersected by a rank axis so that each rank axis is positioned equidistant between longitudinal extremities of the associated bands therein, each successive rank in said stock being identical in configuration and each successive band in a given row of bands being identical in configuration, said first reference axes separating opposing, nonsymmetrical regions of the carrier stock, whereby the stock is particularly designed for use in machine applications which utilize nonsymmetrical application forces.

2. The carrier stock of claim 1 wherein the width of certain portions of each band on one side of the longitudinal axis is greater than corresponding portions of the laterally aligned band on the other side of the longitudinal axis.

3. The carrier stock of claim 2, wherein at least portions of the outermost band segment of each band on one side of the longitudinal axis is greater than a corresponding portion of the outermost band segment of the laterally aligned band on the other side of said longitudinal axis.

4. The carrier stock of claim 1, consisting of two rows of laterally aligned bands.

5. The carrier stock of claim 1 wherein the lateral dimension along the rank axis from the longitudinal axis to the outer margin of the stock on one side of said longitudinal axis is greater than the lateral dimension along said rank axis from said longitudinal axis to the outer margin of the stock on the other side of said longitudinal axis.

6. The carrier stock of claim 2, wherein the lateral dimension along the rank axis from the longitudinal axis to the outer margin of the stock on said one side of said longitudinal axis is less than the lateral dimension along said rank axis from said longitudinal axis to the outer margin of the stock on the other side of said longitudinal axis.

* * * * *